US009277830B2

(12) United States Patent
Schachtner

(10) Patent No.: US 9,277,830 B2
(45) Date of Patent: Mar. 8, 2016

(54) CARRYING DEVICE FOR RECEIVING A BABY OR AN INFANT

(75) Inventor: Petra Schachtner, Marburg (DE)

(73) Assignee: Schachtner Vermoegensverwaltungs GmbH & Co. KG, Marburg-Schroeck (DE)

( * ) Notice: Subject to any disclaimer, the term of this patent is extended or adjusted under 35 U.S.C. 154(b) by 328 days.

(21) Appl. No.: 13/261,192

(22) PCT Filed: Jul. 19, 2010

(86) PCT No.: PCT/EP2010/060394

§ 371 (c)(1),
(2), (4) Date: May 7, 2012

(87) PCT Pub. No.: WO2011/023462

PCT Pub. Date: Mar. 3, 2011

(65) Prior Publication Data

US 2012/0205406 A1 Aug. 16, 2012

(30) Foreign Application Priority Data

Aug. 27, 2009 (DE) ..... 10 2009 038 737

(51) Int. Cl.
*A47D 13/00* (2006.01)
*A47D 13/02* (2006.01)

(52) U.S. Cl.
CPC ..... *A47D 13/025* (2013.01)

(58) Field of Classification Search
CPC ..... A47D 13/02; A47D 13/025
USPC ..... 224/159–161
See application file for complete search history.

(56) References Cited

U.S. PATENT DOCUMENTS

| | | | | |
|---|---|---|---|---|
| 7,252,214 | B2 * | 8/2007 | Krogh | 224/160 |
| 2002/0175194 | A1 | 11/2002 | Norman | |
| 2010/0308087 | A1 * | 12/2010 | Lindbloom | 224/160 |
| 2011/0163136 | A1 * | 7/2011 | Billingham | 224/160 |
| 2012/0286002 | A1 * | 11/2012 | Dardel et al. | 224/159 |

FOREIGN PATENT DOCUMENTS

| | | |
|---|---|---|
| DE | 20 2007 006 204 | 9/2008 |
| DE | 20 2008 013 895 | 3/2009 |
| JP | 2002-253394 | 9/2002 |
| WO | 95/09553 | 4/1995 |
| WO | 2008/135156 | 11/2008 |

* cited by examiner

*Primary Examiner* — Corey Skurdal
(74) *Attorney, Agent, or Firm* — Clark & Brody

(57) ABSTRACT

A carrying device (10) for carrying a baby or an infant by a person, comprises a receiving body (20) having a cloth-like or cushion-like backrest (40) at least in sections with a front side (21) facing toward the carrying person and a back side (22) facing away from the carrying person. The device includes a harness system (30) for fastening the receiving body (20) to the person and can have two cloth-like seating sections (50) attached to the front side (21) of the backrest (40), each having a first end (51) fastened to the front side (21) of the backrest (40) and a loose second end (52). The first ends (51) of the two seating sections (50) are arranged next to one another and the second ends (52) can be detachably fastened to the backrest (40). The seating sections (50) form a sling device T within the receiving body (20).

16 Claims, 4 Drawing Sheets

Figure 1:
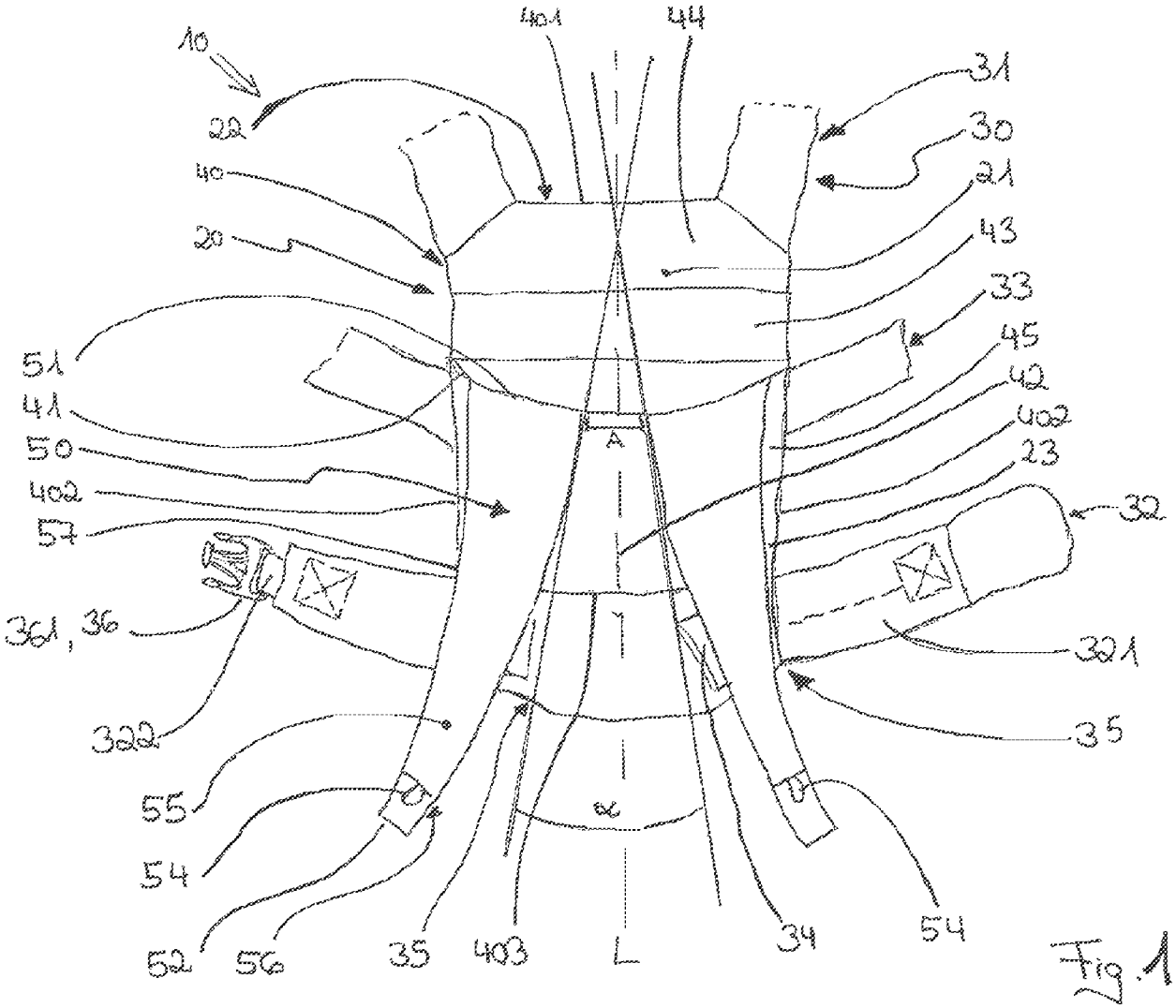

31
44
T
45
V
P
KLick
53
KLick
60
KLick
52
53
40
20
56
32
34

CARRYING DEVICE FOR RECEIVING A BABY OR AN INFANT

The invention relates to a carrying device for receiving a baby or an infant according to the preamble of claim 1.

Carrying devices for babies and/or infants are known in the most diverse embodiments.

With every carrying device it is important that it facilitates a bearing on carrying being anatomically reasonable and particularly back sparing on carrying, both for the carried child and for the carrying adult. Furthermore, it always has to be assured that the carrying device confidently holds the child at the body of the carrying adult.

For this purpose WO 2008/135156 A1 provides a carrying device which consists of an accommodation system for accommodating a baby or an infant and of a holding harness system for fastening the accommodation system to a person. For accommodating the child a main section is formed within the accommodation system exhibiting a slight mold, so that the child sits anatomically correctly like in a preformed bag and the thighs are slightly tucked up. Thereby the child's back is borne by the accommodation system, the child's front side directly leans on the carrying person. At the same time the accommodation system is adjustable in height, so that both babies and infants about 20 kg can be carried.

Problematic at this is that particularly the carrying of neonates, who cannot yet sit autonomously, involves special requirements concerning the baby carrier. So on the one hand the back muscles of the neonates are not yet develepod strongly enough to maintain an anatomically correct position of the back on upright carrying. On the other hand the spine of neonates does not yet have the S-form typical of the upright walk, by means of which shocks along the spine can be absorbed. Thus, with insufficient support by the baby carrier there is a risk that the child develops a humpback. Moreover, shocks, that take effect along the baby's spine on walking of the carrying person, can affect this, if the baby does not sit in an anatomically reasonable position. A too strong inclination of the thighs (splits) should also be avoided with neonates.

To encounter this, WO 2008/135156 A1 provides a seat reduction device. Thereby it is a panel that is fixed with one end at that side of the accommodation system facing the carrier. This panel is drawn up like a diaper from behind through the baby's legs until it covers the child's stomach. Subsequently, with the help of snap fasteners it is fixed at its upper loose angles to the accommodation device.

In this way the child is held in a relatively gentle manner within the accommodation device, however, for the hip joints this seating position is not optimum. In particular there is a risk that the baby, which cannot yet hold its position by itself, sits in a more or less elongated bearing with hanging legs and thighs directed downwards. However, this has to be avoided necessarily so as not to hamper a maturation of the hips.

As an alternative wraparound baby carriers can be used for neonates. These also have crucial disadvantages. So, indeed DE 297 01 891 U1 provides a wraparound baby carrier, within which also neonates can sit in a way that is optimum for sparing the back and the hips. However, this wraparound baby carrier is extremely circuitous to put on. In addition, wraparound baby carriers often create an insecure feeling with the carriers, so that there is a fear the child could slip out of the wraparound baby carrier. In many cases it is also difficult to regulate the tension of the wraparound baby carrier. So usually at first the wraparound baby carrier is put on and subsequently the child is inserted. However, if the child is not yet inserted, the required tension can only roughly be estimated. If in contrast the child is inserted into the wraparound baby carrier having been put on the regulation occurs—provided that it is not at all impossible due to the child's weight—against the child's weight, whereat at the same time the child has to be held with on hand at the body. Accordingly, here also is always a risk that the child is not held in the optimum carrying position.

Thus, task of the invention is to overcome these and further disadvantages of the prior art and to provide a carrying device for babies and infants. In particular the carrying device shall allow a secure and anatomically correct carrying of neonates and be fast and cheaply producible.

Main features of the invention are specified in the distinguishing part of claim 1. Embodiments are the object of claims 2 to 15.

With a carrying device for receiving a baby or an infant, which can be carried by a person, with a receiving body formed cloth-like or cushion-like at least in sections, exhibiting an—at least in sections—cloth-like or cushion-like backrest with a front side facing the carrying person and a back side facing away from the carrying person, and with a harness system for fastening the receiving body to the person, the invention provides that two cloth-like seating sections are attached to the front side of the backrest, each with exhibiting a first end fastened to the front side of the backrest and a loose second end, whereat the first ends of the two seating sections are arranged side by side and whereat the second ends can be detachably fastened to the backrest.

Thereby it is of particular advantage that two cloth-like seating sections are attached to the front side of the backrest. These serve for carrying a notably small child, for example a neonate, which cannot yet sit by itself, in an anatomically optimum position. Thereby the child's thighs are held by the seating sections, while the bottom can sink lower between the seating sections. In this way the child's legs are angled such that the knees lie higher than the bottom. So the child is in an optimum spread-squat-position that is referred to as M position here as the feet, the knees and the bottom lying lower compared to the knees mark the corners of an "M".

Thereby another advantage is, if the upper ends of the seating sections are arranged side by side. In this manner the balancing arrangement is equal and the M position the child is in is symmetrical.

In order to be able to insert the child as simple as possible into the carrying device, it is convenient, if the lower ends of the seating sections are loose. The carrying device can then be spread smoothly on a pad at first, whereat the seating sections bear on the front side of the backrest. Then the child is laid onto the spread carrying device as with winding and the seating sections are led through the legs to the front across the child's stomach. Afterwards the loose ends are fastened to the backrest.

Thereby it is of advantage, if the seating sections are foldable such that their loose lower ends can lie above the fastened upper ends. Thus, the seating sections form carrying loops, which the child's thighs lie in.

To hold the child not only in the hip region, but also at the level of the upper part of the body—and hence in the back region—in an anatomically reasonable way the loose second ends of the seating sections can be led as a seat belt across the opposite shoulder in each case after they have been led through the child's legs. In this way it is hampered that the child can develop a humpback by toppling forward. Instead it is held optimally between the backrest and the seating sections. Accordingly, one finds that is of advantage, if the loose second ends can be fastened to the backrest at the level of the shoulders or above the shoulders of the child to be carried. Thereby it is additionally convenient, if the seating sections are foldable such that they intersect in front of the backrest's front side. Then the child's upper part of the body is essentially held in its middle and at the level of the spine.

It is also advantageous, if the backrest exhibits a main section, in the upper region of which the first ends of the seating sections are fastened along a line running transversely to the longitudinal axis of the backrest. In this way the seating sections are hung up within the receiving body such that the child's bottom always lies lower than the fastening point of the upper ends of the seating sections. Therefore, the child virtually hangs within the receiving body like in a wraparound baby carrier. Consequently, one finds that the seating sections form a wraparound baby carrier device within the receiving body of the carrying device.

In a favored embodiment a distance is formed between the seating sections, preferred between the first ends. This has the advantage that the child's bottom can sink optimally between the two seating sections holding the thighs. Thus, the child automatically sits in the desired M position.

This is additionally facilitated, if the seating sections are arranged to each other at an angle $\alpha$. Then the cloth-like seating sections can be led from the bottom left-hand corner to the top right-hand corner and from the bottom right-hand corner to the top left-hand corner, respectively, without unwanted buckling. This is in particular advantageous as both excoriation of the thighs and pressure marks are avoided.

Furthermore, it is advantageous, if each seating section is formed V-shaped, whereat the first end is broader than the second end. Then the broader ends of the seating sections encompass the thighs and hold these at a relatively large area. This hampers cutting of the seating sections into the legs. However, at the same time the lower ends of the seating sections running within the region of the child's upper part of the body are narrower so that the child can move head and arms unhamperedly. Unwanted chafing and pressing tucks that would emerge with the enforcedly accomplished gathering of seating sections always being consistently broad are advantageously hampered like that.

If at the same time additionally the loose second ends of the seating sections can be fastened to the back side of the backrest, this has the advantage that the child can be lifted out of the device easily, even with the carrying device put on, with no need for putting off the carrying device. One appreciates easily that it is therefore convenient, if the seating sections exhibit fastening elements being fixable in or at fastening devices at the back side of the backrest.

Thereby the seating sections are preferentially designed that way that the seating sections are adjustable between at least two positions such that the seating position is adaptable to the child's height. Thus, in the most simple case it is conceivable, for example, that not only one fastening element, but a series of fastening elements arranged at specific distances to each other is mounted at the second end of the seating sections. Depending on which of the fastening elements is then fixed within the fastening device, the seating section forms a loop of different size so that both smaller and larger children can be held optimally according to their size within the wraparound baby carrier device. Of course it is also thinkable that at the backrest a series of fastening devices is arranged at specific distances to each other, or that the seating sections are continuously adjustable by means of a buckle.

If the child is grown out of the neonatal age and if it can sit autonomously so that the wraparound baby carrier device is no longer needed, another advantage of the carrying device according to the invention is that the seating sections are stowable. For this purpose connecting links through which the seating sections can be led are provided within the region of the harness system, preferred at the hip belt (cf. below). Moreover, the seating sections exhibit fastening elements at their front side. Having been led through the connecting links the loose second ends of the seating sections projecting over the carrying device can be fold to the backrest of the carrying device and be fixed there by means of the fastening elements. Another advantage of the connecting links results from the fact that they can serve to spread the seating sections correctly at first, if the child shall be inserted into the wraparound baby carrier device. Then the seating sections can still be led through the connecting links with their loose second ends, for example, if the child is laid onto the carrying device. Not until the seating sections shall be bent up they are pulled out of the connecting links. Not least the stowability also is of advantage, if the carrying device shall be transported without a child.

In addition, it is convenient, if the harness system exhibits two shoulder belts. The shoulder belts can favorably contain at least one adjusting device for changing the length of the shoulder belt, so that the shoulder belts are adaptable to the build and the height of the carrier. For padding the shoulders the shoulder belts can additionally exhibit shoulder pad sections. Therefore it is convenient, if at least one adjusting device is provided for changing the effective position of the shoulder pad sections.

Beyond, the shoulder belts can have closing devices for opening and closing the shoulder belts. Thereby the closing devices can be secured by a safety device, which hampers an immediate loosening of the shoulder belts after opening of one closing device. Thus, it can be assured that a child held within the carrying device does not directly fall out of the carrying device after loosening of the closing devices at the shoulder belts. The safety device can be formed loop-like, for example, and indeed such, that the closing devices of the shoulder belts stick to the loop-like formed safety device after loosening of the closing devices of the shoulder belts.

Advantageously, the harness system exhibits a hip belt. This can have a closing device for opening and closing, for example, whereat the closing device is also favorably secured by a safety device hampering an immediate loosening and opening, respectively, of the hip belt after opening of the closing device. At this point one realizes that also the wraparound baby carrier device formed by the seating sections serves as an additional safety device. This hampers namely that the child can fall out of the receiving device with opened hip belt.

In further execution examples the carrying device according to the invention can besides exhibit a chest belt that is advantageously fixed to the shoulder belts. This can—in the closed situation—hamper that the shoulder belts slip from the carrier's shoulders.

In a preferred embodiment the carrying device is additionally distinguished by the fact that it exhibits at least one extension element which can be positioned at the receiving body such that the receiving body is extended in altitudinal direction by the extension element.

In this way the receiving body is adjustable in height, so that it is—also for larger children—always optimally adaptable according to their height. Advantageously the extension element can also be formed cloth- and/or cushion-like, whereby an adaptability to the child's body is assured.

The extension element can, for example, be detachably fixed at the receiving body. If a larger infant shall be carried within the carrying device, the extension element is positioned at the receiving body in order to extend this. If the infant is, however, still very small, for example a neonate, the extension element is simply omitted, collected or folded in.

Alternatively, the extension element can be formed one-piece with the receiving body, whereat it is adjustable between at least two positions, in fact one first position, in which the height of the receiving body is not extended by the extension element, and a second position, in which the height of the receiving body is extended by the extension element. Thereby the extension element is advantageously foldable out of the first position into the second position and vice versa. Alternatively, the extension element is rollable or unrollable out of the first position into the second position, or vice versa.

Figure 2B:
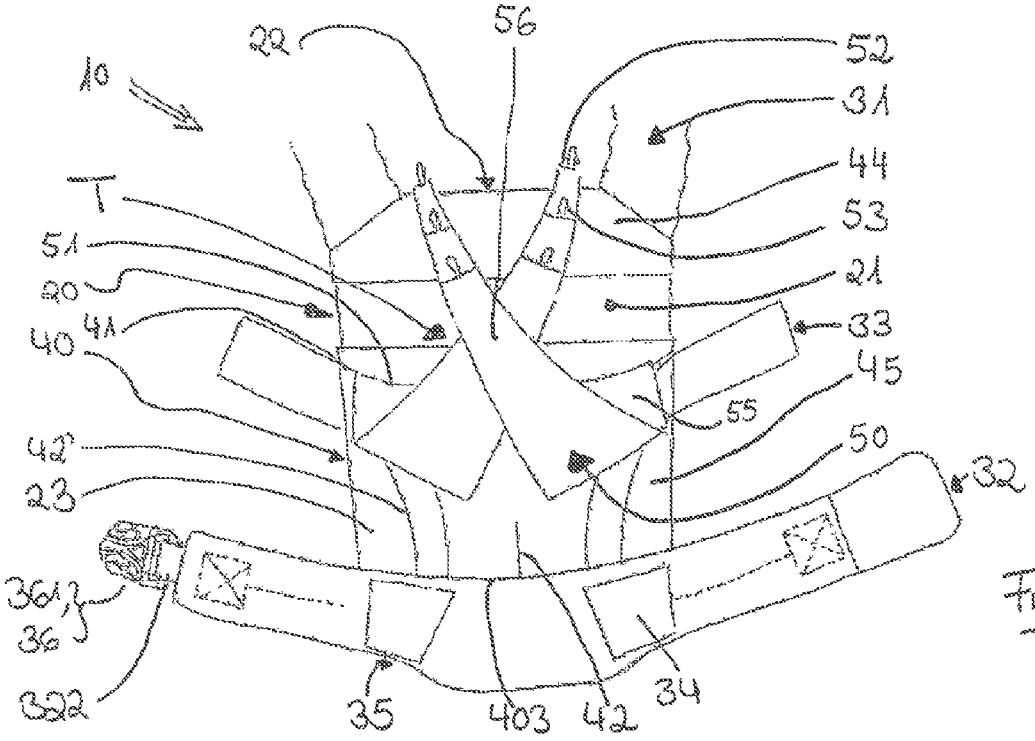
Figure 2A:
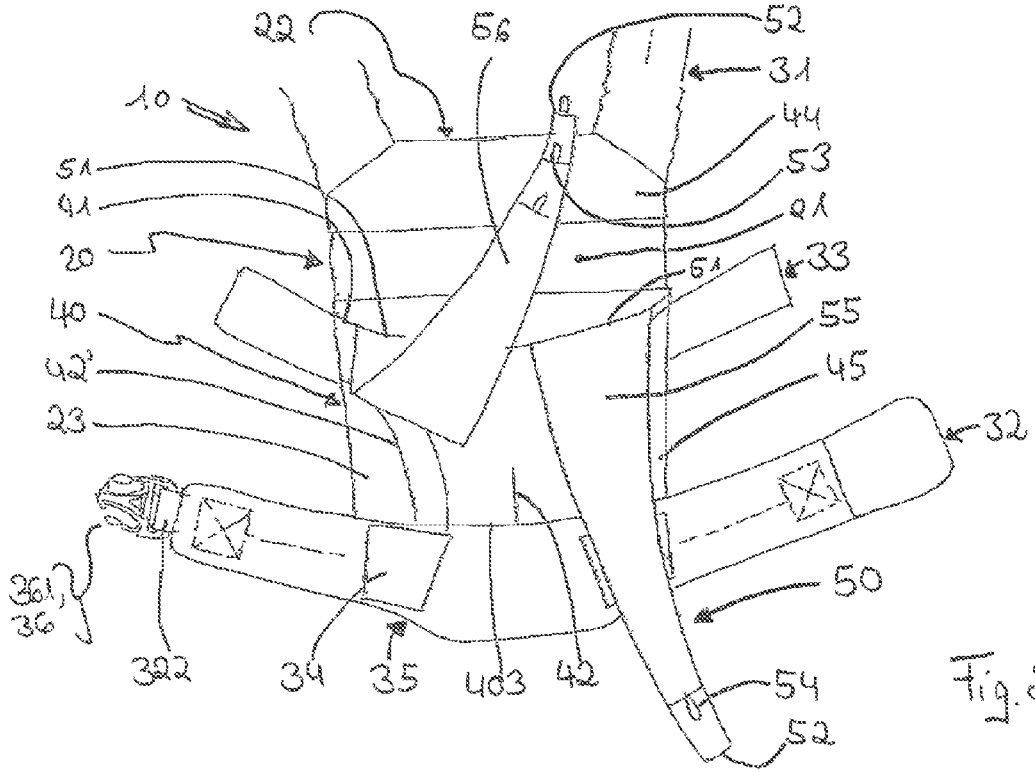
Figure 3:
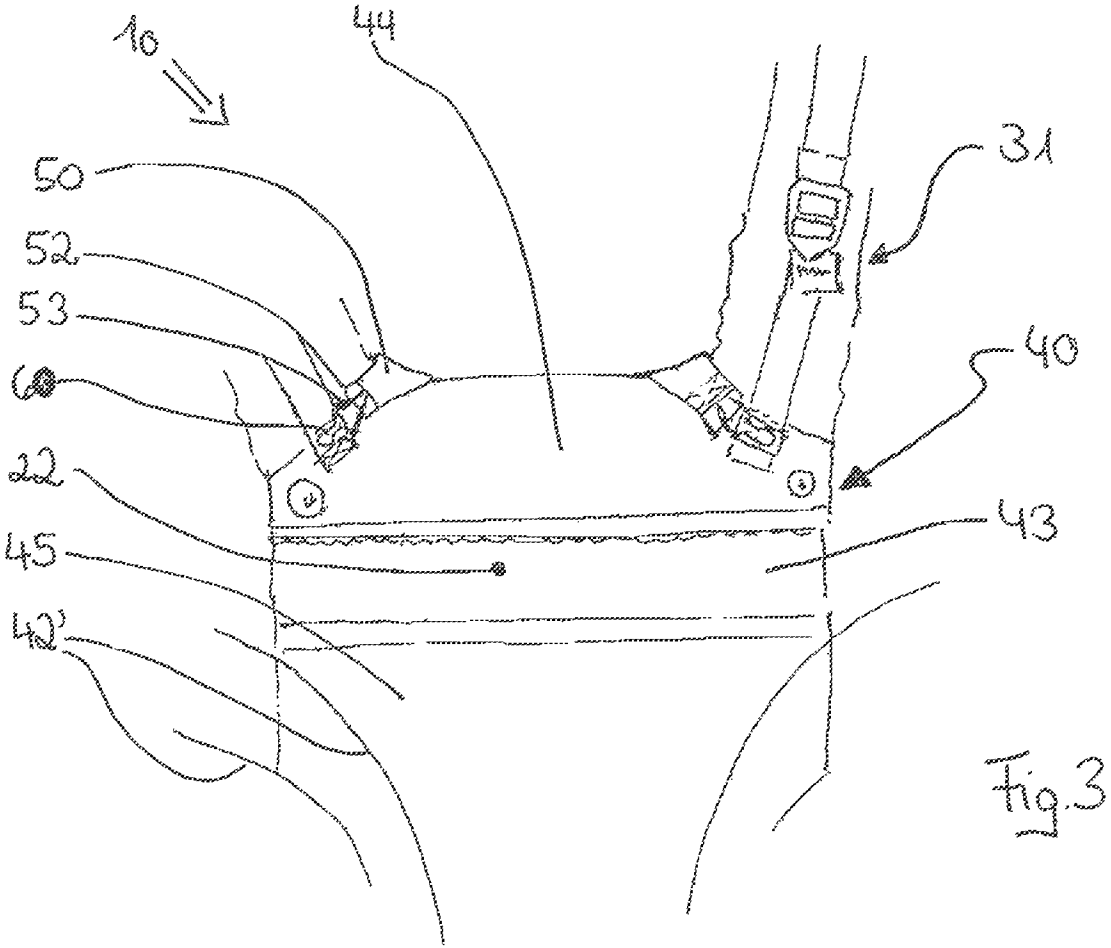
Figure 4:
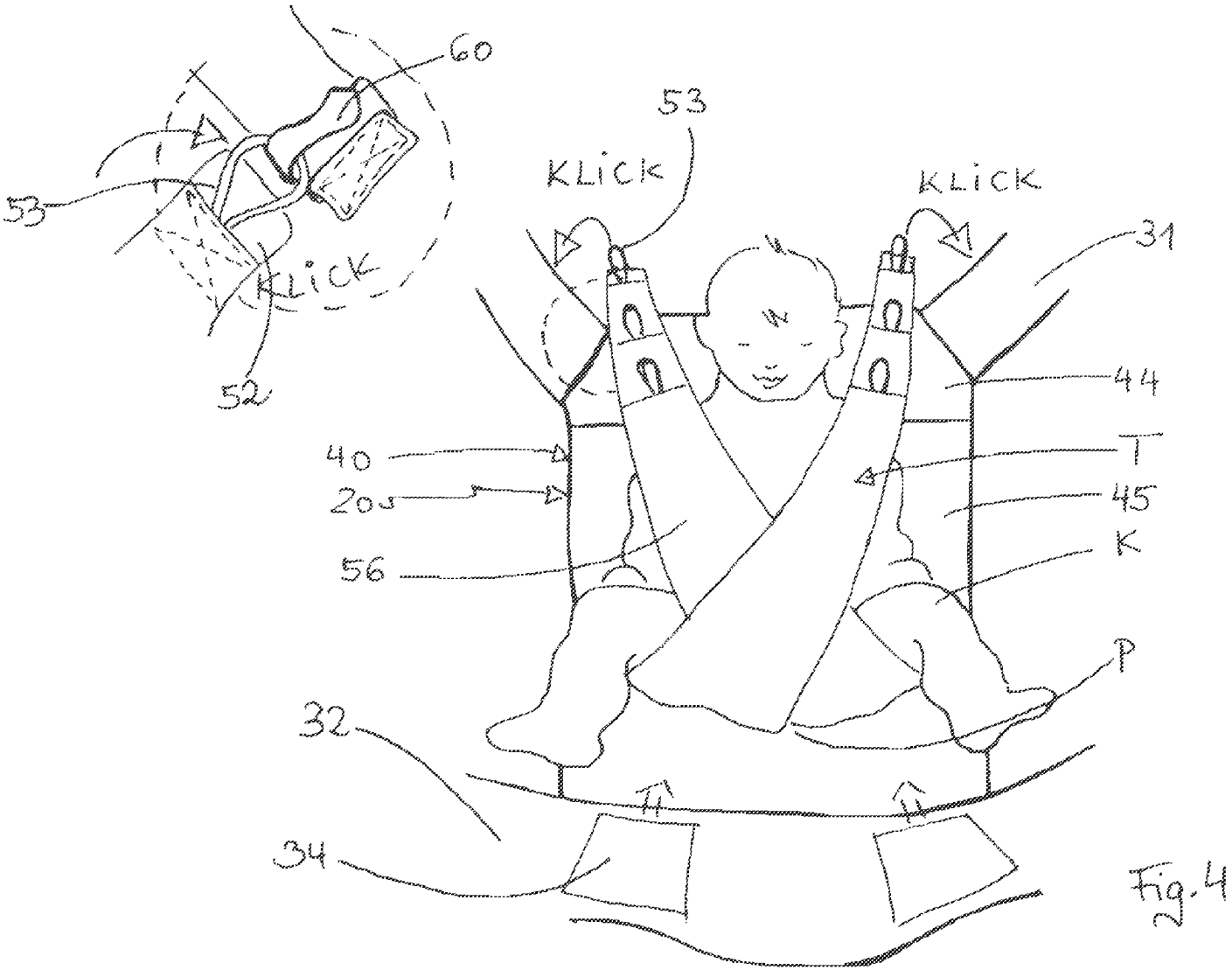

Further characteristics, details and advantages of the invention result from the wording of the claims as well as from the following description of execution examples with the help of the drawings:

FIG. 1A view of the internal side of a carrying device according to the invention in spread situation without child, FIG. 2*a* the perspective of a carrying device according to the invention appropriate to FIG. 1 with a seating section folded according to the invention, FIG. 2*b* the perspective of FIG. 2*a*, whereat the two seating sections are folded according to the invention, FIG. 3 a perspective of the back side of the carrying device according to the invention, FIG. 4 a carrying device according to the invention, in which a child is inserted.

One finds in FIG. 1, that a notably preferred embodiment of the carrying device according to the invention 10 comprises a receiving body 20 and a harness system 30 for fastening the receiving body 20 to a person.

The receiving body 20 consists of a backrest 40 for the child to be carried and two cloth-like seating sections 50 that are fastened to the backrest 40 and serve as seat reduction for the child.

The backrest 40 is made of a stable, single- or multi-layer cloth or cloth-like, shapeable and slightly elastic material and essentially exhibits a rectangular and trapezoidal form, respectively, with a top edge 401, a bottom edge 403 and two opposite lateral edges 402. With the present embodiment it consists of three sections imaged one-piece with each other and arranged one upon the other, namely of a main section 45, an extension section 43 arranged above the main section 45 and a closing-off section 44 arranged above the extension section 43.

In the main section 45 several tucks 42, 42' (cf. also FIGS. 2*a* and 2*b*) are mounted giving the main section 45 a slight mold, so that the child sits anatomically correctly like in a preformed bag. For enhancement of comfort with heavier children the receiving body 20 can additionally be cushioned in the lateral regions 23.

In the upper region of the main section 45 of the backrest 40 a seam 41 running transversely to the longitudinal axis L of the backrest 40 is formed. According to the invention the seating sections 50 are fastened to this seam 41.

Altogether the seating sections 50 have an elongate form with two longitudinal sides 57 and two short sides in each case formed at the first end 51 and at the second end 52 of the seating sections. Related to the backrest 40 they are arranged such that the longitudinal sides 57 essentially run in direction of the longitudinal axis L of the backrest 40, if the carrying device 10 is—as shown in FIG. 1—spread planely in front of the observer. Thereby the first end 51 is fastened to the seam 41, whereas the second end 52 is freely moveable.

One finds in FIG. 1 that the seam 41 is worked slightly curved so that the seating sections 50 are arranged to each other at an angle $\alpha$. Moreover, the first ends 51 of the seating sections 50 are broader than the second ends 52 so that the seating sections 50 have a dihedral altogether. Between the first ends 51 of the two seating sections 50 a distance A is formed.

The seating sections 50 have a front side 55 and a back side 56 in each case. Thereby the front side 55 is facing the body of the child to be carried, when this is inserted into the carrying device 10.

At their second end 52 the seating sections have fastening elements in the form of fastening loops 54, 53 (cf. also FIG. 2*a* and FIG. 2*b*). Thereby fastening loops 54, 53 are mounted both at the front side 55 and at the back side 56 of the seating sections 50.

The harness system 30 comprises two shoulder belts 31 and one hip belt 32.

At the top edge 401 of the backrest 40 the shoulder belts 31 are mounted sideways. When wearing the device these are fastened to connecting links 33 mounted onto the lateral edges 402 in each case.

At the bottom edge 403 of the backrest 40 the hip belt 32 of the harness system 30 is essentially fastened in center. The hip belt 32 consists of a body 321, on which a belt 322 is mounted.

The body 321 is made of an elongate, rectangular cloth material and, in places, padded with expanded material, neoprene or a similarly stabilizing material. Thus, a good deviation of weight onto the hips of the carrying person and a high wearing comfort are assured. Two aliform sections 35 at the lower border of the body 321 enhance the anatomical fit and form—with wearing—appropriate convexities for the carrier's thighs in front of the stomach, if he wants to knee or sit.

The belt 322 is fastened at that side of the body 321 facing away from the carrying person and has a closing device 36 consisting of two closing links 361.

At the body 321 connecting links 34 are also mounted, through which the second ends 52 of the seating sections 50 can be led in direction of the longitudinal axis L of the backrest 40. Subsequently, those regions of the seating sections 50, which project downwards beyond the hip belt 32, can be reverted to the backside 22 of the backrest 40 and be fastened there—by means of the fastening loops 54 mounted onto the front side 55 of the seating sections 50—to the backside 22 of the backrest 40. One realizes that the seating sections 50 are fast and easily stowable this way. This is notably then of advantage, if a somewhat larger child that can already sit autonomously shall be carried with the device according to the invention.

The particular advantage of the carrying device according to the invention 10 is, however, that not only children from the fourth month of life, but also neonates can be carried with it without problems in a firm and anatomically correct bearing.

Especially the seating sections 50 serve for this purpose. These form a fitting within the receiving body 20 working according to the manner of a wraparound baby carrier, as is well recognizable in FIGS. 2*a*, 2*b* and 4.

In FIGS. 2*a* and 2*b* one finds in particular that—for the achievement of the optimum carrying position—the seating sections 50 are folded such that the second ends 52 can lie above the first ends 51 and that the seating sections 50 intersect in front of the front side 21 of the backrest 40. Thereby the second end 52 of the left seating section 50 is led to the top right-hand corner and the second end 52 of the right seating section is led to the top left-hand corner.

Furthermore, one finds that several fastening loops 53 arranged one after another are mounted at the back side 56 of the seating sections in each case. For fastening the second end 52 of the seating sections 50 the second end 52 led up is reverted to the back side 22 of the backrest 40. There—as visible in FIG. 3—one of the fastening loops 53 is hung into an appropriate fastening device in the form of a fastening hook 60 in each case. This way a carrying loop—as with a wraparound baby carrier—forms, which is arranged within the receiving device 20. Thereby the size of the carrying loop can be adapted to the height of the child to be carried by choice of the fastening loop 53. One realizes that the seating sections 50 are adjustable between at least two—in the displayed execution example three—positions such that the seating position is adaptable to the height of the child to be carried. Altogether for this reason the seating sections 50 form a wraparound baby carrier device T within the receiving body 20 of the carrying device 10.

In FIG. 3 one finds, how the led up, loose second ends 52 of the seating sections 50 are reverted to the back side 22 of the backrest 40 and fixed there by means of the fastening elements formed as fastening loops 53. At the back side 22 of the backrest 40 a fastening device in the form of a fastening hook 60 is provided for each seating section 50.

In FIG. 4 one sees, how the child to be carried sits within the wraparound baby carrier device T. Thereby the seating sections 50 run forward between the child's legs. At the same time they encompass that thigh in each case lying in front of the seating section's 50 upper end 51 fastened to the front side 21 of the backrest 40 and are—like a seat belt—led up across that shoulder diagonally opposed to the respective thigh. Thereby the seating sections 50 intersect in front of the stomach and the upper part of the child's body, respectively. One realizes that the seating sections 50 hold the child's bent thighs in an optimum spread-squat-position, whereat the bottom P hangs in the center between the two seating sections 50 and is thus seated lower than the child's knees K. At the same time the seating sections 50 also hamper that the upper part of the child's body can topple forward, while the child's back is held by the backrest 40. Moreover, the child's head and neck area is held by the upper closing-off section 44 of the backrest 40 so that the head cannot fall back.

By means of the carrying device according to the invention 10 it is thus possible to carry a very small neonate, that cannot yet sit autonomously, in an anatomically optimum position. Thereby on the one hand the back is held optimally by two sides, so that no humpback is formed. On the other hand the child sits in a hip-friendly M position, in which the bottom P lies lower than the knees K.

The invention is not confined to one of the embodiments described above, but is conjugable in versatile ways.

So, it is quite imaginable that the seating sections 50 are two rectangular sections in a simplified embodiment. In addition, the seating sections 50 can also be arranged directly parallel to each other. The first ends 51 of the seating sections 50 can touch each other.

For detachable fastening of the second ends 52 quick fasteners, press stud solutions or like that can also be provided. For this purpose, however, it is important, that the seating sections 50 cannot loosen, when the child is inserted into the carrying device 10.

All characteristics and advantages arising from the claims, the description and the figure, inclusively constructional details, spatial arrangements and process steps, can be technically contributing both of their own and in the most different combinations.

One finds that with a carrying device according to the invention 10 for receiving a baby or an infant, which can be carried by a person, with a receiving body 20 formed cloth-like or cushion-like at least in sections, exhibiting an—at least in sections—cloth-like or cushion-like backrest 40 with a front side 21 facing the carrier and a back side 22 facing away from the carrier, and with a harness system 30 for fastening the receiving body 20 to the person, it is notably advantageously, if two cloth-like seating sections 50 are attached to the front side 21 of the backrest 40, each with exhibiting a first end 51 fastened to the front side 21 of the backrest 40 and a loose second end 52, whereat the first ends 51 of the two seating sections 50 are arranged side by side and whereat the second ends 52 can be detachably fastened to the backrest 40. Preferentially, thereby the loose second ends 52 of the seating sections 50 can be fastened to the back side 22 of the backrest 40. For this purpose it is appropriate if the seating sections 50 are foldable such that the loose second ends 52 can lie above the fastened first ends 51 and if the seating sections 50 are foldable such that they intersect in front of the front side 22 of the backrest 40.

One realizes that the seating sections 50 form a wraparound baby carrier device T within the receiving body 20 of the carrying device 10. Thereby it is favorable if the seating sections 50 are arranged at an angle α to each other, if the seating sections 50 are fastened, preferred with their first end 51, along a seam 41 running transversely to the longitudinal axis L of the backrest 40, if between the seating sections 50, preferred between the first ends 51, a distance A is formed and if the seating sections 50 are formed V-shaped, whereat the first end 51 is broader than the second end 52.

Advantageously, the seating sections 50 exhibit fastening elements 53, 54 being fixable in or at fastening devices 60 at the back side 22 of the backrest 40. Thereby it is beneficial if the seating sections 50 are adjustable between at least two positions such that the seating position is adaptable to the height of the child to be carried. It is also convenient if the seating sections 50 are stowable.

One further finds that the harness system 30 exhibits two shoulder belts 31 and that the harness system 30 has a hip belt 32. Moreover, the device exhibits at least one extension element 43 that can be positioned at the receiving body 20 such that the receiving body 20 is extended in altitudinal direction by the extension element 43.

| | |
|---|---|
| A | distance |
| α | angle |
| K | knee |
| L | longitudinal axis |
| P | bottom |
| T | wraparound baby carrier device |
| 10 | carrying device |
| 20 | receiving body |
| 21 | front side |
| 22 | back side |
| 23 | lateral region |
| 30 | harness system |
| 31 | shoulder belt |
| 32 | hip belt |
| 321 | body |
| 322 | belt |
| 33 | connecting link |
| 34 | connecting link |
| 35 | section |
| 36 | closing device |
| 361 | closing link |
| 40 | backrest |
| 401 | top edge |
| 402 | lateral edge |
| 403 | bottom edge |
| 41 | seam |
| 42, 42' | tuck |
| 43 | extension section |
| 44 | closing-off section |
| 45 | main section |
| 50 | seating section |
| 51 | first end |
| 52 | second end |

-continued

| | |
|---|---|
| 53 | fastening loop |
| 54 | fastening loop |
| 55 | front side |
| 56 | back side |
| 57 | longitudinal side |
| 60 | fastening hook |

The invention claimed is:

1. Carrying device (10) for receiving a baby or an infant, which can be carried by a person, with a receiving body (20) formed cloth-like or cushion-like at least in sections, including an—at least in sections—cloth-like or cushion-like backrest (40) with a front side (21) facing the carrying person and a back side (22) facing away from the carrying person, and with a harness system (30) for fastening the receiving body (20) to the person, characterized in that two cloth-like seating sections (50) that are entirely separate and distinct elements for their entire length are attached to the front side (21) of the backrest (40), each seating section (50) including a first end (51) fastened to a middle portion the front side (21) of the backrest (40) and a loose second end (52), whereat the first ends (51) of the two seating sections (50) are arranged side by side and whereat the second ends (52) can be detachably fastened to the backrest (40), and wherein the two-cloth-like seating sections (50) intersect in front of the front side (22) of the backrest (40) when the second ends are detachably fastened to the backrest (40).

2. Device according to claim 1, characterized in that the loose second ends (52) of the seating sections (50) can be fastened to the back side (22) of the backrest (40).

3. Device according to claim 1, characterized in that the seating sections (50) are foldable such that the loose second ends (52) can lie above the fastened first ends (51).

4. Device according to claim 1, characterized in that the seating sections (50) form a wraparound baby carrier device (T) within the receiving body (20) of the carrying device (10).

5. Device according to claim 1, characterized in that the seating sections (50) are arranged at an angle $\alpha$ to each other.

6. Device according to claim 1, characterized in that the seating sections (50) are fastened along a seam (41) running transversely to the longitudinal axis (L) of the backrest (40).

7. Device according to claim 6, characterized in that the seating sections (50) are fastened using first ends (51) along the seam (41) running transversely to the longitudinal axis (L) of the backrest (40).

8. Device according to claim 1, characterized in that a distance (A) is formed between the seating sections (5).

9. Device according to claim 8, characterized in that the distance (A) is formed between the first ends (51).

10. Device according to claim 1, characterized in that the seating sections (50) are formed V-shaped, whereat the first end (51) is broader than the second end (52).

11. Device according to claim 1, characterized in that the seating sections (50) include fastening elements (53, 54) that are fixable in or at fastening devices (60) at the back side (22) of the backrest (40).

12. Device according to claim 1, characterized in that the seating sections (50) are adjustable between at least two positions such that a seating position is adaptable to the height of the child to be carried.

13. Device according to claim 1, characterized in that the seating sections (50) are stowable.

14. Device according to claim 1, characterized in that the harness system (30) includes two shoulder belts (31).

15. Device according to claim 1, characterized in that the harness system (30) includes a hip belt (32).

16. Device according to claim 1, characterized in that the carrying device includes at least one extension element (43) that can be positioned at the receiving body (20) such that the receiving body (20) is extended in altitudinal direction by the extension element (43).

* * * * *